United States Patent [19]

Simons

[11] Patent Number: 4,662,455

[45] Date of Patent: May 5, 1987

[54] SPRINKLER HEAD

[75] Inventor: John R. Simons, Greendale, Wis.

[73] Assignee: Grunau Company, Inc., Milwaukee, Wis.

[21] Appl. No.: 743,300

[22] Filed: Jun. 10, 1985

[51] Int. Cl.[4] ..... A62C 37/10

[52] U.S. Cl. ..... 169/37

[58] Field of Search ..... 169/37–41, 169/90; 137/359; 285/46

[56] References Cited

U.S. PATENT DOCUMENTS

| | | | |
|---|---|---|---|
| 2,211,399 | 8/1940 | Winslow | 169/39 |
| 2,534,066 | 12/1950 | Rowley | 169/38 |
| 2,946,329 | 7/1960 | Metcalfe | 169/37 X |
| 4,366,866 | 1/1983 | Sweeney | 169/37 |

*Primary Examiner*—Jeffrey V. Nase

*Attorney, Agent, or Firm*—Andrus, Sceales, Starke & Sawall

[57] ABSTRACT

An improved recessed sprinkler head including a frame having a base portion with an outlet to be connected to a source of water under pressure. The frame also includes a pair of curved arms which extend outwardly from the base portion and are connected together at a junction. The outlet is normally enclosed by a cap which is retained in position by a releasable mechanism that includes an element arranged to release when the sprinkler head is exposed to a predetermined elevated temperature. A disc-like support member having a central aperture of sufficient size to receive the arms of the frame is slipped upwardly over the frame after the sprinkler head is connected to the water line, and the support member includes a pair of opposed flexible resilient tabs that are adapted to engage an abutment on the base portion of the frame. An annular sleeve is positioned outwardly of the frame, and the lower end of the sleeve defines a decorative ring. Biasing means, such as a compression spring, is interposed between the support member and the sleeve to urge the decorative ring upwardly against the ceiling of the building and to permit the ring to float in accordance with relative movement between the water system and the ceiling.

6 Claims, 4 Drawing Figures

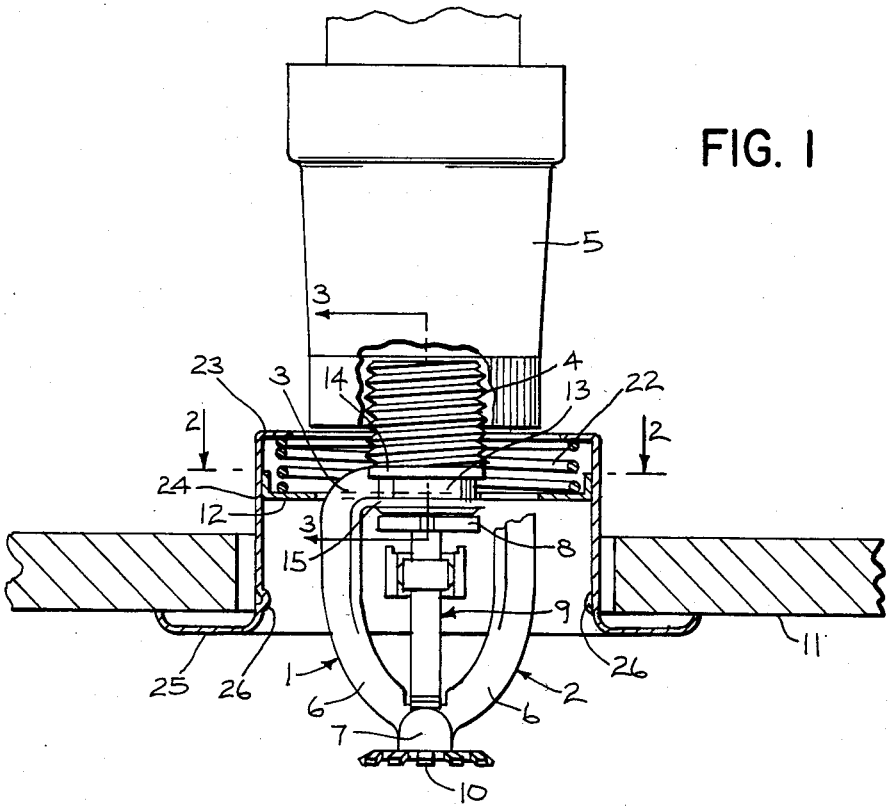
FIG. 1
FIG. 2
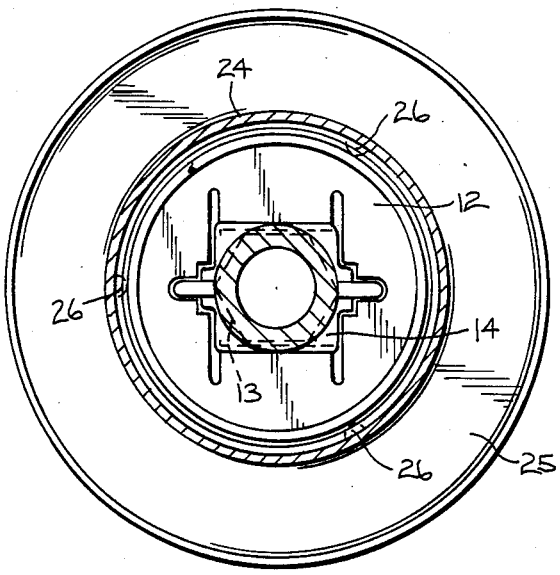
FIG. 3
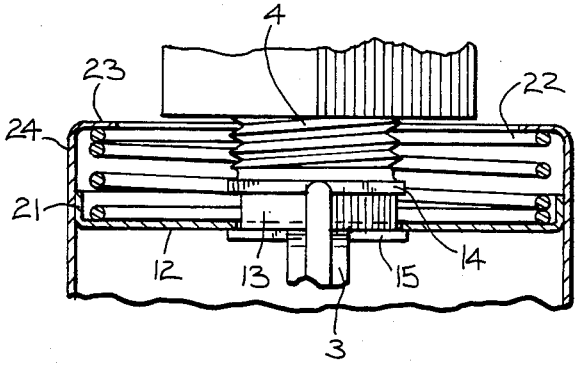
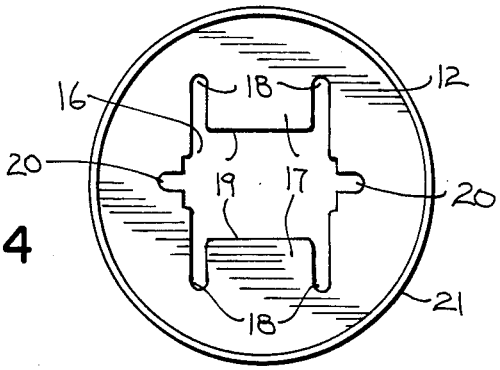
FIG. 4

SPRINKLER HEAD

BACKGROUND OF THE INVENTION

A common type of sprinkler head, as used in an automatic sprinkler system, is a recessed type in which the sprinkler head is partially mounted within a recess in the ceiling and the lower portion of the sprinkler head is exposed beneath the ceiling.

A recessed sprinkler head normally includes a cup-like member which is spaced outwardly of the sprinkler head and carries a decorative ring that bears against the lower surface of the ceiling to hide the opening in the ceiling within which the sprinkler head is mounted. The cup and decorative ring can be moved relative to the sprinkler head so that after the sprinkler head is connected to the water line, the cup is moved upwardly to bring the decorative ring in contact with the ceiling.

With the conventional recessed sprinkler head, the cup member and decorative ring are normally pre-assembled with the sprinkler head prior to connecting the head to the water line. In some cases, the cup member is carried by a support plate which is threaded onto the upper end of the sprinkler head, while in other cases the support plate is slipped over the upper threaded end of the sprinkler head and supported on the frame.

After connection of the sprinkler head to the water line, testing of the system is required. The primary location of possible leakage is at the threaded connection between the sprinkler head and the water line. With the cup member and support plate pre-assembled with the sprinkler head, it is difficult to see if leakage is occurring at the threaded joint.

Another problem encountered with recessed sprinkler heads, as used in the past, is that very often relative movement occurs between the water piping system and the ceiling due to settling of the building. If the water line moves downward relative to the ceiling, a gap occurs between the decorating ring and the ceiling which can cause an unattractive appearance. On the other hand, if the water line moves upwardly relative to the ceiling, increased stress can be applied to the sprinkler head due to the added weight of the ceiling.

Because of this problem, attempts have been made to provide a floating action for the decorative ring to permit the ring to float in accordance with relative movement between the water line and the ceiling. For example, U.S. Pat. No. 3,389,884 shows a sprinkler head assembly in which a cup-shaped support member is threaded on the upper end of the sprinkler head, and a sleeve, which carries a decorative ring, is connected to the support member through a compression spring. With this construction, the biasing effect of the spring will compensate for relative movement between the water line and the ceiling, enabling the decorative ring to be maintained in intimate contact with the ceiling. However, the sprinkler head construction of the aforementioned patent has a disadvantage in that the support plate, sleeve and decorative ring must be pre-assembled to the sprinkler head before the sprinkler head is connected to the water line. With this pre-assembled construction, special tools are required to thread the sprinkler head to the water line, and because of the presence of the sleeve and support plate, it is difficult to observe if leakage occurs at the threaded joint during testing of the water system.

SUMMARY OF THE INVENTION

The invention is directed to an improved recessed or concealed sprinkler head having a floating decorative ring that is installed on the sprinkler head after the sprinkler head is connected to the water line.

In accordance with the invention, the frame of the sprinkler head includes a base having an outlet connected to the water line and the frame also includes a pair of curved arms that extend outwardly from the base and are connected together at an end or junction. The outlet is normally enclosed by a cap which is retained in place by a releasable mechanism, such as a lever mechanism, that includes a fusible element. WHen the element is exposed to a pre-set elevated temperature, the element will melt to enable the lever mechanism to release and unseat the cap and open the outlet.

The sprinkler head also includes a disc-like member formed of sheet metal and having a central opening of sufficient size to receive the arms of the frame as the member is slipped upwardly over the sprinkler head. The disc-like member includes a pair of opposed, flexible tabs that are adapted to engage a groove in the base of the frame as the disc-like member is slipped upwardly over the sprinkler head.

A cylindrical sleeve is positioned outwardly of the frame and the lower end of the sleeve carries a decorative ring. A compression spring is interposed between a flange on the sleeve and the disc-like member and serves to bias the decorative ring upwardly against the ceiling.

With the sprinkler head of the invention, the head can be connected to the water line and the line tested for leaks before installation of the sleeve and decorative ring. As the disc-like member and sleeve are not in position during testing, leakage through the threaded joint is readily observable.

The biasing connection between the sleeve and the disc-like member provides a flating action which enables the decorative ring to move with the ceiling should there by relative movement between the water line and the ceiling, thereby maintaining the ring in intimate contact with the ceiling at all times.

With a conventional recessed sprinkler head, in which the sleeve and decorative ring are pre-assembled to the head before the head is connected to the water line, it is necessary to install the ceiling tiles before the sprinkler head is connected to the water line. Conversely, the ceiling tiles cannot be removed unless the sprinkler head is disconnected from the water line and disconnection of the head requires draining of the entire water line. On the other hand, with the spinkler head of the invention, the disc-like support member, sleeve and decorative ring can be removed from the sprinkler head, when the head is connected to the water line, so that the ceiling tiles can then be removed without the need of disconnecting the sprinkler head from the water line and draining the water line.

As the support member, sleeve and decorative ring are not attached to the sprinkler head when it is connected to the water line, the sprinkler head can be attached with standard tools.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of the spinkler head of the invention as connected to a water line;

FIG. 2 is a section taken along line 2—2 of FIG. 1;

FIG. 3 is a section taken along line 3—3 of FIG. 1; and

FIG. 4 is a plan view of the supporting disc.

DESCRIPTION OF THE PREFERRED EMBODIMENT

FIG. 1 illustrates a recessed sprinkler head 1 including a cast metal frame 2. Frame 2 includes a base portion 3 having an externally threaded outlet 4 which is connected to the water line 5.

Frame 2 also includes a pair of opposed curved arms 6 that extend outwardly from base 3 and the lower ends of the arms are connected together at a junction 7.

Outlet 4 is normally closed by a cap 8 which is held in the closed position by a lever assembly 9. Lever assembly 9, which forms no part of the present invention, can take the form of that shown in the pending United States patent application Ser. No. 534,729, filed Sept. 22, 1983, now abandoned or can take the form of that shown in U.S. Pat. No. 4,376,465. The lever assemblies as disclosed in the aforementioned patent application and patent include a fusible element or alloy, and when the sprinkler head is subjected to a predetermined elevated temperature, the fusible element will melt to cause the lever assembly to be released so that the water pressure in line 5 will dislodge the cap 8 and permit the water to be discharged from the outlet. To deflect the water outwardly, a deflector 10 can be mounted on the lower portion of the junction 7.

Sprinkler head 1, as illustrated in FIG. 1 is a recessed type in which the upper portion of the sprinkler head is located above the lower surface of the ceiling 11. The sprinkler head of the invention can also be a concealed type in which the entire sprinkler head is located above the lower surface of the ceiling.

In accordance with the invention, a sheet metal support member or disc 12 is engaged with the base portion 3 of frame 2. As best shown in FIG. 3, the disc 12 is engaged with a groove 13 that is bordered by a pair of spaced ribs 14 and 15 on base portion 3. As shown in FIG. 2, ribs 14 and 15 have a generally square configuration while groove 13 is polygonal, preferably hexagonal, and is adapted to receive a wrench that is used to thread the sprinkler head to the water line.

As illustrated in FIG. 4, the support member or disc 12 is formed with a central opening 16 and a pair of opposed flexible resilient tabs 17, each of which is defined by a pair of spaced parallel slits 18, border opening 16. The inner edge 19 of each tab is engaged with groove 13 to maintain the support member 12 in position on the sprinkler head.

The central opening 16 in the support member 12 is also provided with a pair of opposed recesses 20 which receive arms 6 of frame 2.

As illustrated in FIG. 3, the peripheral edge of support member 12 is provided with upstanding flange 21, and a compression spring 22 is seated between the support member 12 and the inwardly extending flange 23 on sleeve 24. Sleeve 24 is spaced radially outward of the arms 6 of frame 2.

The lower end of sleeve 24 terminates in an outwardly extending decorating ring 25 which is adapted to bear against the lower surface of ceiling 11 when the sprinkler head is fully installed.

Support disc 12, sleeve 24 and spring 22 constitute a pre-assembled unit which is installed with the sprinkler head after the sprinkler head is connected to the water line. The inner surface of sleeve 24 is provided with a plurality of nibs or projections 26, which prevent the support disc 12 from being dislodged from the sleeve in the pre-assembled unit.

To install the sprinkler head 1, the head, without attachment of the support disc 12 and sleeve 24, is threaded to water line 5. As the disc 12 is not attached to the sprinkler head at this time, a standard wrench engaged with the groove 13 can be utilized to thread the spinkler head to the water line. After connection to the water line, the water system can be tested for leaks, and as the disc and sleeve are not attached at this time, any leakage through the threaded joint will be readily observable.

The pre-assembled unit, consisting of support disc 12, spring 22 and sleeve 24, is then inserted on the sprinkler head by slipping the disc 12 upwardly over the arms 6, the flexible tabs 17 will be deflected downwardly as they pass over the lower rib 15 and will then snap into place in the groove 13 to hold the disc 12 into position relative to the frame 2. In this position, spring 22 will urge the decorative ring 25 into tight engagement with the lower surface of ceiling 11.

The lower end of water line 5 is positioned accurately relative to the lower surface of ceiling 11 so that on installation of the sprinkler head, spring 22 will be partially compressed, thereby allowing float in both up and down directions. If the water line 5 should move downwardly relative to the ceiling 11 over a period of time, spring 22 will maintain the ring in engagement with the ceiling. Conversely, if the water line 5 moves upwardly relative to the ceiling 11, further compression of the spring 22 will occur to prevent undue load being applied to the sprinkler head. Thus, the sprinkler head of the invention is capable of floating both up and down to compensate for variations in height between the water line and the ceiling.

As a further advantage, the sprinkler head can be connected to the water line before the ceiling is installed and the ceiling tiles can be removed without disconnecting the sprinkler head and draining the entire water system.

Various modes of carrying out the invention are contemplated as being within the scope of the following claims particularly pointing out and distinctly claiming the subject matter which is regarded as the invention.

I claim:

1. A sprinkler head to be connected to a water system in a building, comprising a frame including a base having an outlet to be connected to said water system, said frame also including a pair of arms extending downwardly from said base and having the lower extremities of the arms connected together at a junction, said base having a pair of vertically spaced abutments bordering a groove, said groove having a polygonal shape in horizontal cross section, a cap to close said outlet, releasable means interconnecting the cap and the junction for releasing said cap when the sprinkler head is exposed to a predetermined elevated temperature, a support member having an opening of sufficient size to receive said frame as said support member is slipped upwardly over the frame, said support member also having a pair of opposed flexible tabs bordering said opening, each tab being defined by a pair of spaced slits, and each tab has a free edge engaged with said groove, said tabs being flexible in a vertical direction, said tabs being constructed and arranged to flex downwardly as said support member is slipped upwardly over said frame and to engage said groove to retain said support member on said frame, a generally cylindrical sleeve disposed outwardly of said frame and mounted for vertical movement relative to said support member, a ring carried by the lower end of said sleeve and extending laterally outward from said sleeve, and biasing means interconnecting said support member and said sleeve for biasing said ring upwardly into engagement with a ceiling of said building.

2. The spinkler head of claim 1, and including an inwardly extending flange on the upper end of said sleeve, said biasing means extending between said flange and said support member.

3. The sprinkler head of claim 2, wherein said biasing means comprises a compression spring.

4. The sprinkler head of claim 1, wherein said flexible element comprises a tab having a base portion integral with said support member and having a free inner edge disposed to engage said abutment means.

5. The sprinkler head of cliam 1, wherein said opening includes a pair of opposed recesses, said recesses being constructed and arranged to receive the arms of the frame as the support member is moved upwardly over said frame.

6. A sprinkler head to be connected to a water system in a building, comprising a frame including a base having an outlet to be connected to said water system, said frame also including a pair of arms extending downwardly from said base and having the lower extremities of said arms connected together at a junction, a rib extending laterally outward of said base, the portion of said base located upwardly of said rib having a smaller cross sectional area than said rib, a cap to close said outlet, releasable means interconnecting the cap and the junction for releasing said cap when the sprinkler head is exposed to a predetermined elevated temperature, a support disc having a central opening constructed to receive said frame as said disc is slipped upwardly over the frame, said disc also having at least one flexible resilient tab bordering said opening, said disc being slipped upwardly over the frame and said tab being constructed and arranged to flex donwwardly as said tab passes upwardly over said rib and said tab snapping into engagement with said portion, a generally cylindrical sleeve disposed outwardly of said frame and mounted for vertical movement relative to said support disc, a decorative ring carried by the lower end of said sleeve and extending laterally outward from said sleeve, and biasing means interconnecting said support disc and said sleeve for biasing said ring upwardly into engagement with the ceiling of said building.

* * * * *

UNITED STATES PATENT AND TRADEMARK OFFICE

CERTIFICATE OF CORRECTION

PATENT NO. : 4,662,455

DATED : May 5, 1987

INVENTOR(S) : JOHN R. SIMONS

It is certified that error appears in the above-identified patent and that said Letters Patent is hereby corrected as shown below:

Col. 1, Line 40, Cancel "decorating" and substitute therefor ---decorative---; Col. 2, line 14, Cancel "WHen" and substitute therefor ---When---; Col. 2, Line 38, Cancel "flating" and substitute therefor ---floating---; Col. 3, Line 66, Cancel "decorating" and substitute therefor ---decorative---; Col. 5, CLAIM 2, Line 12, Cancel "spinkler" and substitute therefor ---sprinkler---; Col. 5, CLAIM 4, Lines 19-22, Delete "4. The sprinkler head of claim 1, wherein said flexible element comprises a tab having a base portion integral with said support member and having a free inner edge disposed to engage said abutment means."; Col. 5, CLAIM 5, Line 1, Cancel "cliam" and substitute therefor ---claim---.

Signed and Sealed this

Thirteenth Day of December, 1988

*Attest:*

DONALD J. QUIGG

*Attesting Officer*

*Commissioner of Patents and Trademarks*